US006906633B2

(12) United States Patent
Berthold et al.

(10) Patent No.: US 6,906,633 B2
(45) Date of Patent: Jun. 14, 2005

(54) PROGRAM-CONTROLLED HOUSEHOLD APPLIANCE

(75) Inventors: Arndt Berthold, Leipzig (DE); Bernd Czeslick, Traunreut (DE); Konrad Götz, Kelheim (DE); Holger Kress, Nürnberg (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 244 days.

(21) Appl. No.: 10/194,862

(22) Filed: Jul. 12, 2002

(65) Prior Publication Data

US 2003/0031016 A1 Feb. 13, 2003

(30) Foreign Application Priority Data

Jul. 12, 2001 (DE) ..... 101 34 010

(51) Int. Cl.[7] ..... G08B 5/00; G09G 3/18

(52) U.S. Cl. ..... 340/815.4; 340/815.44; 340/815.47; 340/815.53; 345/38; 345/50; 345/104; 345/902

(58) Field of Search ..... 340/815.4, 815.45, 340/815.53, 815.44, 815.47, 525, 461, 460, 462; 345/694, 698, 695, 3.1, 38, 50, 56, 87, 104, 902, 960

(56) References Cited

U.S. PATENT DOCUMENTS 4,163,229 A * 7/1979 Bodin et al. ..... 345/20
4,692,760 A * 9/1987 Unno et al. ..... 345/30
5,410,647 A * 4/1995 Peaslee et al. ..... 345/467
5,880,710 A * 3/1999 Jaberi et al. ..... 345/618
6,100,858 A * 8/2000 Tran ..... 345/59

FOREIGN PATENT DOCUMENTS

DE 196 06 115 A1 8/1996

* cited by examiner

*Primary Examiner*—Donnie L. Crosland
(74) *Attorney, Agent, or Firm*—John T. Winburn; Russell W. Warnock; Craig J. Loest

(57) ABSTRACT

The optical indicator unit of a program-controlled household appliance includes one or more indicator elements for the display of information in plain text. Each indicator element includes a matrix with 5×8 pixels for the display of a character. Each indicator element is assigned a functional element/actuator belonging to the household appliance. The element/actuator and also at least one operating state of the element/actuator is represented in the indicator element by an initial letter or a symbol. Depending on a size of the display, a plurality of actuators can be indicated at the same time. The invention can be applied particularly well in testing and in servicing.

20 Claims, 2 Drawing Sheets

PROGRAM-CONTROLLED HOUSEHOLD APPLIANCE

BACKGROUND OF THE INVENTION

Field of the Invention

The invention relates to a program-controlled household appliance having an optical indicator unit including one or more indicator elements for the display of user and program information and also test and service information as plain text and as symbols.

One trend in modern household appliances is that their functional scope is being expanded more and more. This is done extensively by the incorporation of additional subassemblies (for example, microwave in the cooker or dryer in the washing machine) but also intensively as a result of better utilization and adaptation of existing subassemblies to a greater number of specific requirements.

As a result, the user is offered a wider and wider palette of possible applications: the number of selectable operating modes, the possible variations and programs increases. Associated therewith are operating instructions that become ever more comprehensive, and the correct selection of the programs becomes more and more difficult. This is countered by the manufacturers by the user being assisted through the appliances or their programs, with the aim of dispensing with the operating instructions if possible.

Modern household appliances with a wide functional scope and a large palette of possible applications have a display in the operating area that, under program control, indicates to the user tips and information relating to the program and to the program sequence in plain text. The intention is for the user to be guided in an informative way by the indications in the display such that the programming of the household appliance can be matched optimally to the specific application. The display is normally built up from a row of characters or a plurality of rows of characters disposed under one another, each character including a DOT matrix of 8×5 pixels. For each character, a number or a letter is indicated, symbols above a plurality of characters.

The configuration of the indicators in the display is based on the requirements and demands of the user, who is generally technically not educated. The items of information needed by the user have to be output in a form that satisfies the technical layperson, that is to say, only common terms must be used and abbreviations are to be displayed only in the generally common manner of writing (for example, "Temp." for temperature) and symbols, if possible, in a self-explanatory form. Misunderstandings and, therefore, erroneous operations are to be avoided. To such an end, the user is to be informed as comprehensively as possible, at least adequately but also still comprehensively. In such a case, the size of the existing display sets relatively close limits.

A very convenient solution for indication by a display is contained in German Published, Non-Prosecuted Patent Application DE 196 06 115 A1. In this document, plurality of displays are integrated into the operating panel of an oven to output information in plain text. To display the indications in a more comprehensible way, each display is associated with a specific function, for example, for the program indication, for the indication of the set parameters, and for the clock time.

In principle, the existing displays can also be used for test programs and service in that the designation of the module or actuator to be tested and its respective operating state are indicated. However, this form of display does not prove to be optimal; the items of information appear one after another; the engineer does not receive the desired summary relating to the interaction of the various actuators.

SUMMARY OF THE INVENTION

It is accordingly an object of the invention to provide a program-controlled household appliance that overcomes the hereinafore-mentioned disadvantages of the heretofore-known devices of this general type and that provides a significantly improved range of information, in particular, for test and service engineers, with a comparatively low economic expenditure. Substantially, this means that the units available for appliance operation are used. Furthermore, it is an object of the invention to offer a satisfactory solution for less convenient displays.

With the foregoing and other objects in view, there is provided, in accordance with the invention, a program-controlled household appliance including an optical indicator unit having at least one indicator element adapted to simultaneously display user and program information and test and service information as plain text and as symbols, the at least one indicator element simultaneously displaying a symbol and a letter character.

The solution according to the invention is based on the idea that the information requirement of a test or maintenance engineer differs significantly from that of a potential user of the household appliance. The user of a household appliance is initially assisted through the indicators in the display in the correct selection of the program and, when the program is running, is informed about the progress or the current state of the program. The indications appear one after another. Their content must be so extensive and accurate for the user that misinterpretations are ruled out.

For the engineer who is checking the household appliance, what matters, instead, is that a large number of items of information are indicated at the same time, in order to display the operating states of the various subassemblies in conjunction with or in relation to their dependence on one another. This is done in that each DOT matrix is subdivided into two mutually independent areas and these can be driven separately from each other, in that, an upper area (5×5 pixels) is provided for the designation of the actuator and a lower area (3×5 pixels) for the possible operating states. It is advantageous to symbolize the actuator by an initial letter of its name.

The symbols for identifying the operating states can, in principle, be chosen freely, but should not be configured abstractly but appear plausible to the observer. They should be meaningful and easily remembered so that after a relatively short time, it is possible to dispense with written documents such as operating instructions or character tables. Under this premise, an area of 5×5 pixels for the display of an alphanumeric character is sufficient and, in an area with a size of 3×5 pixels, a sufficiently large supply of reliably distinguishable symbols can be indicated.

In accordance with yet an additional feature of the invention, the at least one indicator element has a DOT matrix of 8×5 pixels, an area of 5×5 pixels of the DOT matrix is reserved for display of the letter character, and a second area of 3×5 pixels of the DOT matrix is reserved for display of the symbol.

Because the user of the solution according to the invention is an engineer in the final production of the manufacturing company or of the customer services facility, the symbols do not have to meet any great requirements in relation to their configuration. The characters displayed do not have to meet normal standards nor have a self-explanatory character.

It is merely necessary to demand that the symbols are unambiguous and have adequate distinguishability.

In accordance with another feature of the invention, the symbol is one of a plurality of symbols, the letter character is one of a plurality of characters, the letter character is a given character, the given character is associated with a subset of the symbols, and the at least one indicator element is adapted to only activate and display the subset of symbols when the given character is indicated.

In accordance with a further feature of the invention, the at least one indicator unit is a display having LCD elements and each of the LCD elements has a 5×8 pixel matrix.

In accordance with an added feature of the invention, each of the LCD elements is divided up into two separately driven areas.

In accordance with an additional feature of the invention, there is provided at least one of a functional unit and a subassembly, each of the functional unit and the subassembly having an operating state, and the letter character is one of a plurality of characters, each of the characters is assigned to one of the functional unit and the subassembly, and the operating state is displayed by the at least one indicator element with the symbol.

With the objects of the invention in view, in a program-controlled household appliance having functional units each with at least one operating and monitoring state, there is also provided an optical indicator unit including at least one indicator element adapted to simultaneously display, as plain text and as symbols, user and program information regarding the at least one operating and monitoring state of each functional unit and test and service information regarding the at least one operating and monitoring state of each functional unit, the at least one indicator element simultaneously displaying a symbol and a letter character.

In accordance with yet another feature of the invention, the functional units include at least one of the group consisting of a motor and a heater.

In accordance with yet a further feature of the invention, the motor has states including an on state and an off state.

In accordance with yet an added feature of the invention, the motor has states including a clockwise-rotating state and a counter-clockwise rotating state.

In accordance with a concomitant feature of the invention, the heater has states including a heating state and an off state.

Other features that are considered as characteristic for the invention are set forth in the appended claims.

Although the invention is illustrated and described herein as embodied in a program-controlled household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
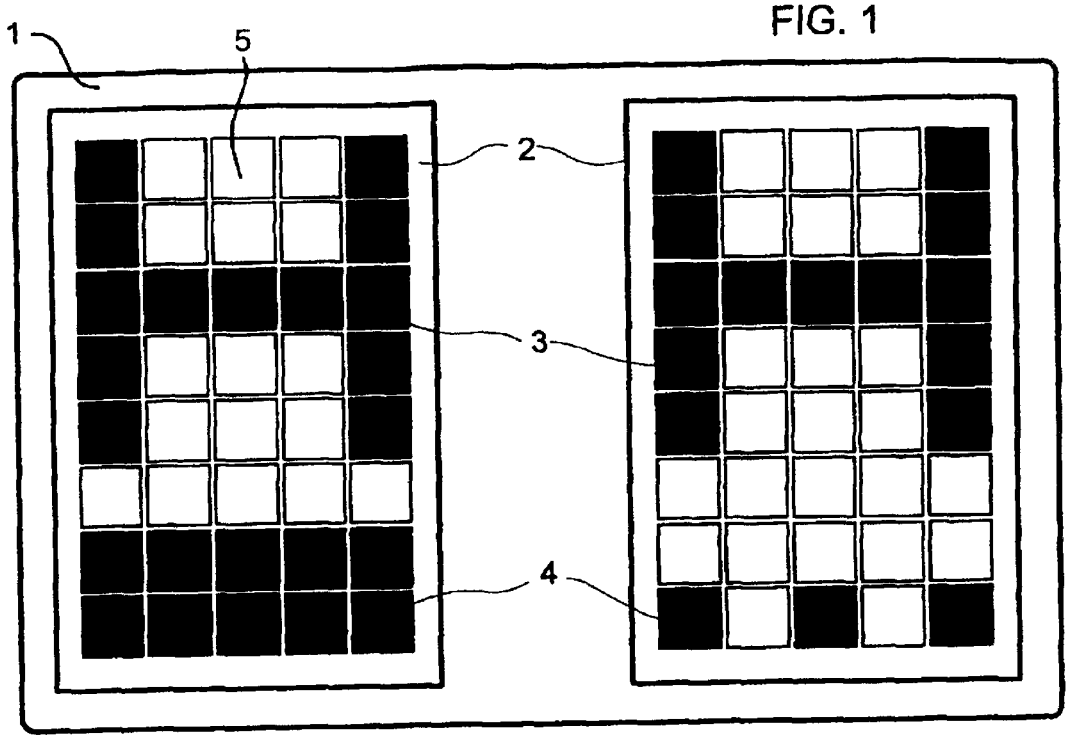
FIG. 1 is a diagrammatic illustration of a DOT matrix according to the invention for a "heating" actuator (H) when switched on and when switched off.
Figure 2:
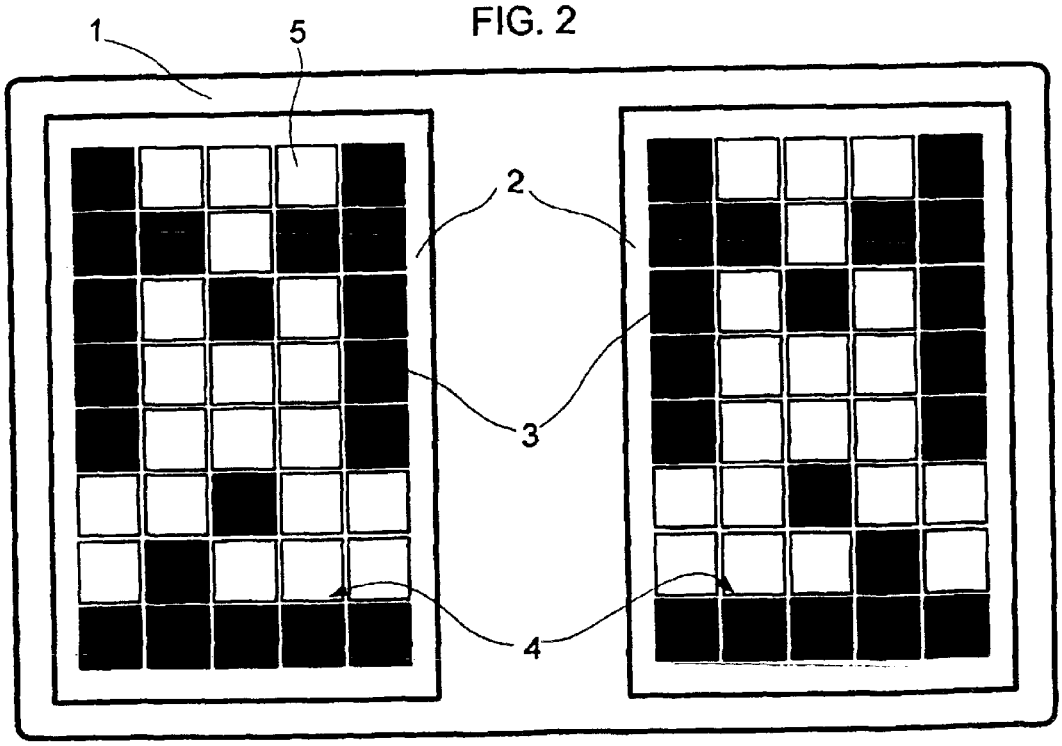
FIG. 2 is a diagrammatic illustration of a DOT matrix according to the invention for a "motor" actuator (M) when running counter-clockwise and when running clockwise.

Referring now to the figures of the drawings in detail and first, particularly to FIGS. 1 and 2 thereof, there are shown various examples of possible character displays. Each DOT matrix is a module 2 in a non-illustrated display that is part of an appliance 1, only shown diagrammatically. FIG. 1 contains the representation of two operating states for the "heating" actuator 3. The actuator itself is advantageously identified by the initial letter H, for which the area of 5×5 pixels, as can be seen in FIG. 1, is completely adequate. The symbols 4 for the two possible operating states of the heating can be chosen freely. The selection made here, following the model of conventional luminous indicators, is to have a greater luminosity in the case of "heating ON" (seen in the left half of FIG. 1) than in the case of "heating OFF" (seen in the right half of FIG. 1). The selection of other symbols 4 is possible.

A second character ("M") for the "motor" actuator 3 can be seen in FIG. 2. The initial letter M for "motor" is likewise depicted in the upper area, the directions of rotation "ccw" and "cw" are symbolized by characters 4 disposed underneath. Although these symbols 4 do not have to be self-explanatory, in the present case, to accord with the direction of rotation, arrow points are symbolized and, by emphasizing the corresponding sides, the characters 4 appear plausible and, therefore, easy to remember.

The possible third state "motor OFF" can likewise be displayed. For such a purpose, for reasons of uniformity and to make it easier to remember, the same symbol should be used as in the case of "heating OFF". The number of characters that can be displayed at the same time depends on the size of the display and the demand on the number of pixels displayed to achieve adequate legibility. Each element can be occupied by the indicator for one actuator.

The indicating areas on each DOT matrix can be interchanged without deviating from the invention so that the indicator for the actuator is disposed at the bottom and that for its state at the top. Departing therefrom, the entire DOT matrix can also be rotated through 90°, so that the indicator areas for the actuator are located on the left or right and those for its state are located on the right or left.

Figure 3:
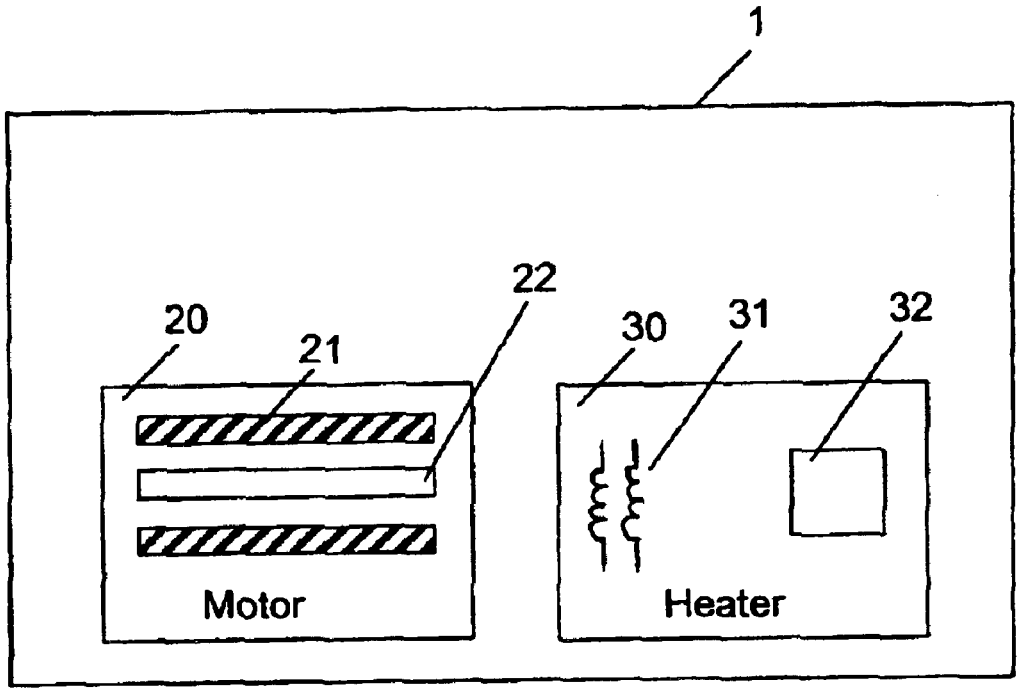
FIG. 3 is a diagrammatic illustration of an appliance having a motor and a heater.

FIG. 3 illustrates a generic appliance having a motor 20 and a heater 30. The motor 20 has subassemblies such as a stator 21 and a rotor 22. The heater 30 has subassemblies such as heater coils 31 and a fan 32.

We claim:

1. A program-controlled household appliance comprising:

an optical indicator unit having at least one indicator element adapted to simultaneously display user and program information and test and service information as plain text and as symbols, said at least one indicator element simultaneously displaying a symbol and a letter character.

2. The household appliance according to claim 1, wherein:

said symbol is one of a plurality of symbols;

said letter character is one of a plurality of characters;

said letter character is a given character;

said given character is associated with a subset of said symbols; and said at least one indicator element is adapted to only activate and display said subset of symbols when said given character is indicated.

3. The household appliance according to claim 1, wherein:

said at least one indicator unit is a display having LCD elements; and each of said LCD elements has a 5×8 pixel matrix.

4. The household appliance according to claim 3, wherein each of said LCD elements is divided up into two separately driven areas.

5. The household appliance according to claim 1, wherein:

said at least one indicator element has a DOT matrix of 8×5 pixels;

an area of 5×5 pixels of said DOT matrix is reserved for display of said letter character; and a second area of 3×5 pixels of said DOT matrix is reserved for display of said symbol.

6. The household appliance according to claim 1, including at least one of a functional unit and a subassembly, each of said functional unit and said subassembly having an operating state, and wherein:

said letter character is one of a plurality of characters;

each of said characters is assigned to one of said functional unit and said subassembly; and said operating state is displayed by said at least one indicator element with said symbol.

7. The household appliance according to claim 6, wherein:

said symbol is one of a plurality of symbols;

said symbols are freely selectable; and said characters include initial letters of a name of said functional unit and a name of said subassembly.

8. In a program-controlled household appliance having functional units each with at least one operating and monitoring state, an optical indicator unit comprising:

at least one indicator element adapted to simultaneously display, as plain text and as symbols, user and program information regarding the at least one operating and monitoring state of each functional unit and test and service information regarding the at least one operating and monitoring state of each functional unit, said at least one indicator element simultaneously displaying a symbol and a letter character.

9. The household appliance according to claim 8, wherein:

said symbol is one of a plurality of symbols;

said letter character is one of a plurality of characters;

said letter character is a given character;

said given character is associated with a subset of said symbols; and said at least one indicator element is adapted to only activate and display said subset of symbols when said given character is indicated.

10. The household appliance according to claim 8, wherein:

said at least one indicator unit is a display having LCD elements; and each of said LCD elements has a 5×8 pixel matrix.

11. The household appliance according to claim 10, wherein each of said LCD elements is divided up into two separately driven areas.

12. The household appliance according to claim 8, wherein:

said at least one indicator element has a DOT matrix of 8×5 pixels;

an area of 5×5 pixels of said DOT matrix is reserved for display of said letter character; and a second area of 3×5 pixels of said DOT matrix is reserved for display of said symbol.

13. The household appliance according to claim 8, wherein:

said letter character is one of a plurality of characters;

each of said characters is assigned to one of the functional units; and the at least one operating and monitoring state is displayed by said at least one indicator element with said symbol.

14. The household appliance according to claim 13, wherein;

said symbol is one of a plurality of symbols;

said symbols are freely selectable; and said characters include initial letters of a name of each of the functional units.

15. The household appliance according to claim 8, wherein the functional units include at least one of the group consisting of a motor and a heater.

16. The household appliance according to claim 15, wherein the motor has states including an on state and an off state.

17. The household appliance according to claim 16, wherein the motor has states including a clockwise-rotating state and a counter-clockwise rotating state.

18. The household appliance according to claim 15, wherein the heater has states including a heating state and an off state.

19. A method of displaying information, which comprises the steps of:

providing a program-controlled household appliance having an optical indicator and functional units each with at least one operating and monitoring state;

simultaneously displaying, as plain text and as symbols, user and program information regarding the at least one operating and monitoring state of each of the functional units and test and service information regarding the at least one operating and monitoring state of each of the functional units.

20. The method according to claim 19, which further comprises simultaneously displaying a symbol and a letter character.

* * * * *